US011047173B1

(12) United States Patent
Giordano

(10) Patent No.: US 11,047,173 B1
(45) Date of Patent: Jun. 29, 2021

(54) LADDER SAFETY APPARATUS

(71) Applicant: Phil Giordano, Lombard, IL (US)

(72) Inventor: Phil Giordano, Lombard, IL (US)

( * ) Notice: Subject to any disclaimer, the term of this patent is extended or adjusted under 35 U.S.C. 154(b) by 0 days.

(21) Appl. No.: 17/153,846

(22) Filed: Jan. 20, 2021

Related U.S. Application Data

(60) Provisional application No. 63/119,787, filed on Dec. 1, 2020.

(51) Int. Cl.
*E06C 7/48* (2006.01)
*E06C 7/18* (2006.01)

(52) U.S. Cl.
CPC ..... *E06C 7/488* (2013.01); *E06C 7/182* (2013.01)

(58) Field of Classification Search
CPC . E06C 7/48; E06C 7/488; E06C 7/484; E06C 7/486; E06C 7/183; E06C 7/182
See application file for complete search history.

(56) References Cited

U.S. PATENT DOCUMENTS 1,502,490 A * 7/1924 Tack ..... E06C 7/48 182/214
2,432,781 A * 12/1947 Mann ..... E06C 1/345 182/206
2,541,343 A * 2/1951 Dakin ..... E06C 7/16 248/238
2,680,554 A * 6/1954 Dakin ..... E06C 7/16 182/214
2,722,360 A * 11/1955 Malm ..... E06C 7/488 182/214
2,797,037 A * 6/1957 Niedojadlo ..... E06C 7/48 182/107
2,881,028 A * 4/1959 Baird ..... E06C 7/16 182/116
2,934,163 A * 4/1960 Ladewski ..... E06C 7/48 182/214
3,318,416 A * 5/1967 Robinson ..... E06C 7/488 182/214
4,143,743 A * 3/1979 Larson ..... E06C 7/48 182/107
4,159,045 A * 6/1979 Brooks ..... E06C 7/16 182/116
4,279,327 A * 7/1981 Warren ..... E06C 1/345 182/152

(Continued)

*Primary Examiner* — Alvin C Chin-Shue
*Assistant Examiner* — Shiref M Mekhaeil
(74) *Attorney, Agent, or Firm* — Gulf Coast Intellectual Property Group

(57) ABSTRACT

A ladder safety apparatus that is configured to be secured to an edge of a flat roof top wherein the present invention is configured to releasably secure a top end of an extension ladder so as to inhibit movement thereof. The present invention includes a roof top support member configured to be secured to a roof top proximate the edge thereof. A first ladder riser receiving member and a second ladder riser receiving member are secured to the roof top support member on distal ends thereof. A first grab rail member and a second grab rail member extend upward from the roof top support member providing grab rails during exiting from the top of the ladder. The first ladder riser receiving member and second ladder riser receiving member include a structure having voids to operably engage a portion of a ladder riser.

15 Claims, 3 Drawing Sheets

(56) References Cited

U.S. PATENT DOCUMENTS 4,331,217 A * 5/1982 Stecklow ..... E06C 7/48 182/107
4,339,020 A * 7/1982 Wiseman ..... E06C 7/48 182/107
4,444,291 A * 4/1984 McPherson ..... E06C 7/486 182/107
4,502,566 A * 3/1985 Wing ..... E06C 7/48 182/107
4,643,274 A * 2/1987 Tataseo ..... E06C 7/48 182/106
4,765,439 A * 8/1988 Kresmery ..... E06C 7/48 182/107
4,823,912 A * 4/1989 Gould ..... E06C 7/484 182/107
5,165,501 A * 11/1992 Donahey ..... E06C 7/42 182/107
5,242,031 A * 9/1993 Ashley ..... E06C 7/48 182/129
5,261,507 A * 11/1993 Williams ..... E06C 7/48 182/214
5,743,356 A * 4/1998 Mitchell ..... E06C 7/48 182/107
5,941,343 A * 8/1999 Kelsey ..... E06C 7/48 182/107
6,029,774 A * 2/2000 Cothern ..... E06C 7/188 182/107
6,158,551 A * 12/2000 Gray ..... E06C 7/14 182/107
6,405,828 B1 * 6/2002 Redding ..... E06C 7/48 182/107
6,578,666 B1 * 6/2003 Miller ..... B60R 3/007 182/106
6,837,338 B2 * 1/2005 Grover ..... E06C 7/48 182/107
7,322,442 B2 * 1/2008 Clark ..... E06C 7/182 182/106
8,235,175 B1 * 8/2012 Feldhaus ..... E06C 7/486 182/214
8,602,163 B2 * 12/2013 Davis, Jr. ..... E06C 7/48 182/107
8,839,907 B2 * 9/2014 Davis, Jr. ..... E06C 7/182 182/107
8,839,908 B2 * 9/2014 Davis, Jr. ..... E06C 7/182 182/107
8,997,932 B1 * 4/2015 Ochoa ..... E06C 7/48 182/206
D760,917 S * 7/2016 Ellis ..... D25/68
9,404,306 B2 * 8/2016 Russell ..... E06C 7/48
9,580,963 B1 * 2/2017 Wilkes ..... E06C 7/488
9,593,532 B2 * 3/2017 Dehoff ..... E06C 7/48
10,883,310 B2 * 1/2021 Johnson ..... E06C 7/48
2005/0023084 A1 * 2/2005 Lazarus ..... E06C 7/482 182/214
2005/0139425 A1 * 6/2005 Thomas ..... E06C 1/34 182/214
2008/0202850 A1 * 8/2008 Anderson ..... E06C 7/182 182/106
2009/0000868 A1 * 1/2009 Gaines ..... E06C 7/182 182/106
2011/0315478 A1 * 12/2011 Foster, Sr. ..... E06C 1/345 182/129
2014/0318894 A1 * 10/2014 Chow ..... E06C 7/48 182/214
2015/0075905 A1 * 3/2015 Ballard ..... E06C 7/48 182/107
2016/0102497 A1 * 4/2016 Riopel ..... E06C 7/423 182/107
2016/0215563 A1 * 7/2016 Ellis ..... E06C 7/48
2017/0058605 A1 * 3/2017 Napolitano ..... E06C 7/488
2018/0016843 A1 * 1/2018 Milton ..... E06C 7/48
2018/0327002 A1 * 11/2018 Nasrabad ..... B61D 3/20
2019/0257152 A1 * 8/2019 MacKarvich ..... E06C 7/182

* cited by examiner

LADDER SAFETY APPARATUS

PRIORITY UNDER 35 U.S.C SECTION 119(e) & 37 C.F.R. SECTION 1.78

This nonprovisional application claims priority based upon the following prior United States Provisional Patent Application entitled: Ladder Safety Apparatus, Application No. 63/119,787 filed Dec. 1, 2020, in the name of Phil Giordano, which is hereby incorporated by reference for all purposes.

FIELD OF THE INVENTION

The present invention relates generally to ladder safety, more specifically but not by way of limitation, a ladder safety apparatus that is configured to releasably secure an extension ladder, specifically an upper portion thereof, adjacent an edge of a flat roof so as to ensure a stable position and further provide additional rail members for exiting the top of the ladder.

BACKGROUND

Millions of people regularly utilize extension ladders. Both professional and do-it yourself individuals will utilize an extension ladder in order to perform certain tasks. As is known in the art, extension ladders comprise of two sections wherein the sections are slidably coupled and are configured to extend the overall length of the ladder. The position of the two portions of a conventional extension ladder range from being adjacent each other to having one section substantially extended outward from the other. It is in the aforementioned position that the extension ladder can become quite unstable and flex under the weight of a user. Individuals will regularly extend the length of extension ladders to reach areas such as but not limited to second stories of buildings.

One issue with extension ladders is the safety concerns once the ladder is extended into a position so as to reach a second story. Extension ladders are generally eighteen inches wide and once extended to lengths greater than fifteen feet are very unstable. A long narrow ladder lacks the proper lateral stability to ensure the safety of a user while climbing the ladder. Additionally, as conventional ladders are made of metal or fiberglass, these ladders will slide when placed against hard surfaces creating a safety hazard.

It is intended within the scope of the present invention to provide ladder safety apparatus that is configured to releasably secure a top portion of an extension ladder that is placed against a roof edge wherein the present invention ensures lateral stability and further provides additional grab rail members to ensure a safer exit from the top of the ladder onto a rooftop.

SUMMARY OF THE INVENTION

It is the object of the present invention to provide a ladder safety apparatus that is configured to releasably secure a portion of an extension ladder that has been placed against a flat rooftop wherein the present invention includes a frame manufactured from a durable material such as but not limited to metal.

Another object of the present invention is to provide a ladder accessory that is configured ensure stability of the ladder when leaned against a roof edge wherein the frame includes a support member that is planar in manner and rectangular in shape.

A further object of the present invention is to provide a ladder safety apparatus that is configured to releasably secure a portion of an extension ladder that has been placed against a flat rooftop wherein the support member has a first end and second end and further includes a plurality of apertures operable to have fasteners journaled therethrough.

Still another object of the present invention is to provide a ladder accessory that is configured ensure stability of the ladder when leaned against a roof edge that includes a first ladder riser receiving member wherein the first ladder rail receiving member is present at the first end of the support member and includes a first plate member and a second plate member having a void therebetween.

An additional object of the present invention is to provide a ladder safety apparatus that is configured to releasably secure a portion of an extension ladder that has been placed against a flat rooftop that includes a second ladder riser receiving member wherein the second ladder riser receiving member is present at the second end of the support member and includes a first plate member and a second plate member having a void therebetween.

Yet a further object of the present invention is to provide a ladder accessory that is configured ensure stability of the ladder when leaned against a roof edge wherein the first ladder rail receiving member includes a hook member hingedly secured thereto.

Another object of the present invention is to provide a ladder safety apparatus that is configured to releasably secure a portion of an extension ladder that has been placed against a flat rooftop wherein the second ladder rail receiving member includes a hook member hingedly secured thereto.

An alternate object of the present invention is to provide a ladder accessory that is configured ensure stability of the ladder when leaned against a roof edge that includes a first grab rail member wherein the first grab rail member extends upward from the first end of the support plate.

Still a further object of the present invention is to provide a ladder safety apparatus that is configured to releasably secure a portion of an extension ladder that has been placed against a flat rooftop that includes a second grab rail member wherein the second grab rail member extends upward from the second end of the support plate.

An additional object of the present invention is to provide a ladder accessory that is configured ensure stability of the ladder when leaned against a roof edge wherein the first grab rail member and second grab rail member have a void therebetween.

A further object of the present invention is to provide a ladder safety apparatus that is configured to releasably secure a portion of an extension ladder that has been placed against a flat rooftop wherein the first grab rail member and second grab rail member are axially aligned with the rails of the extension ladder secured thereto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
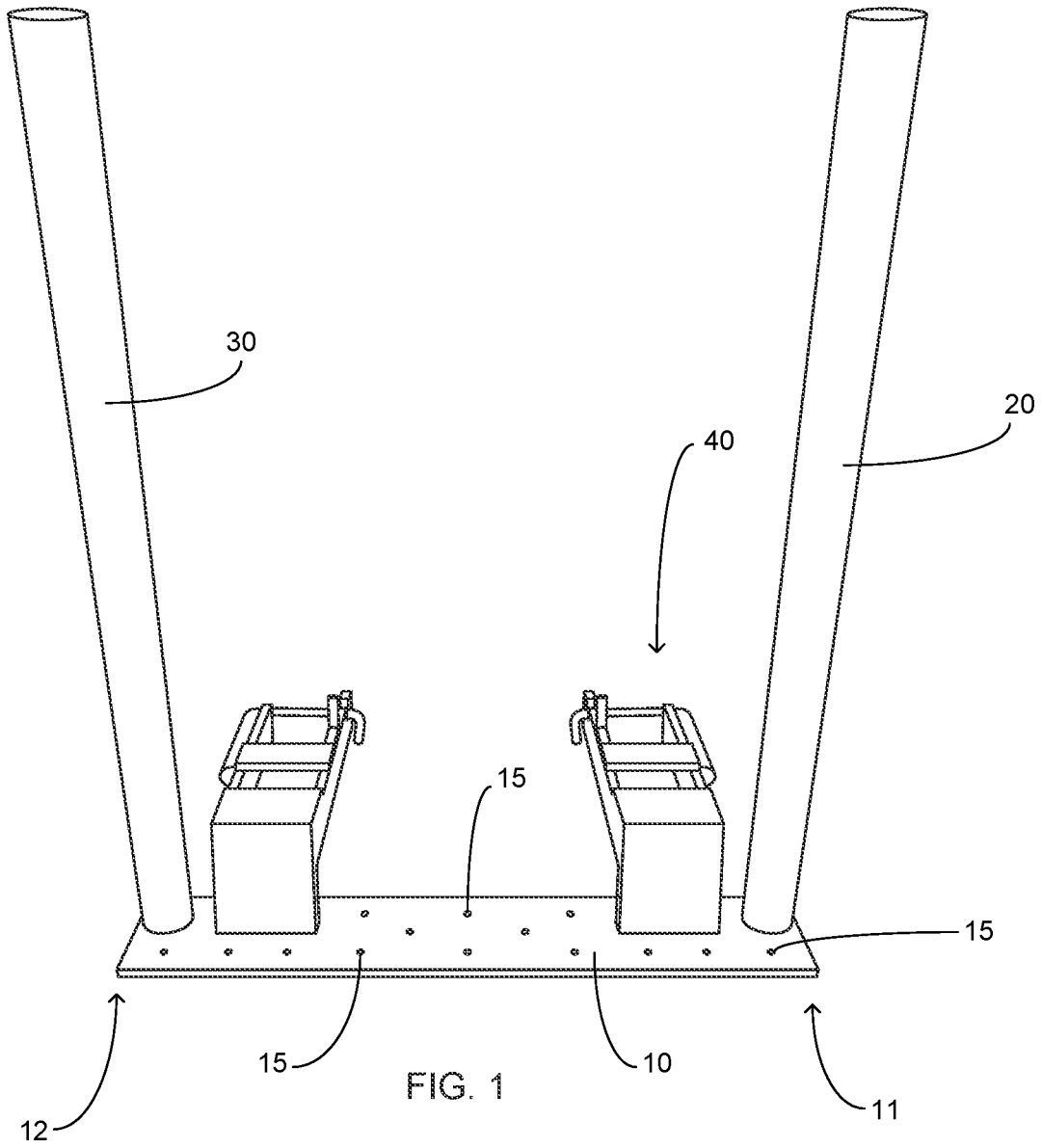
FIG. 1 is a rear perspective view of the present invention.
Figure 2:
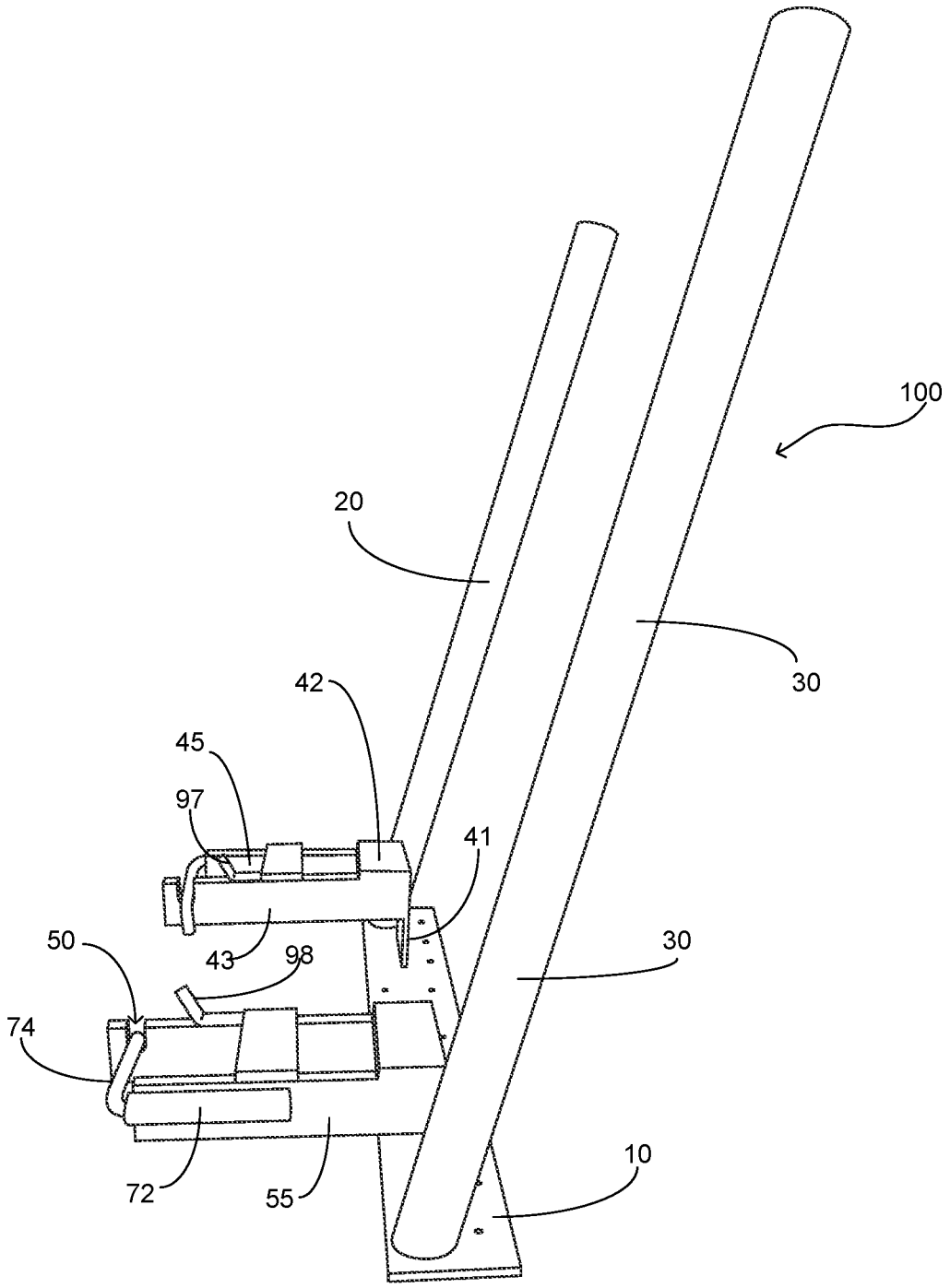
FIG. 2 is a side view of the present invention.
Figure 3:
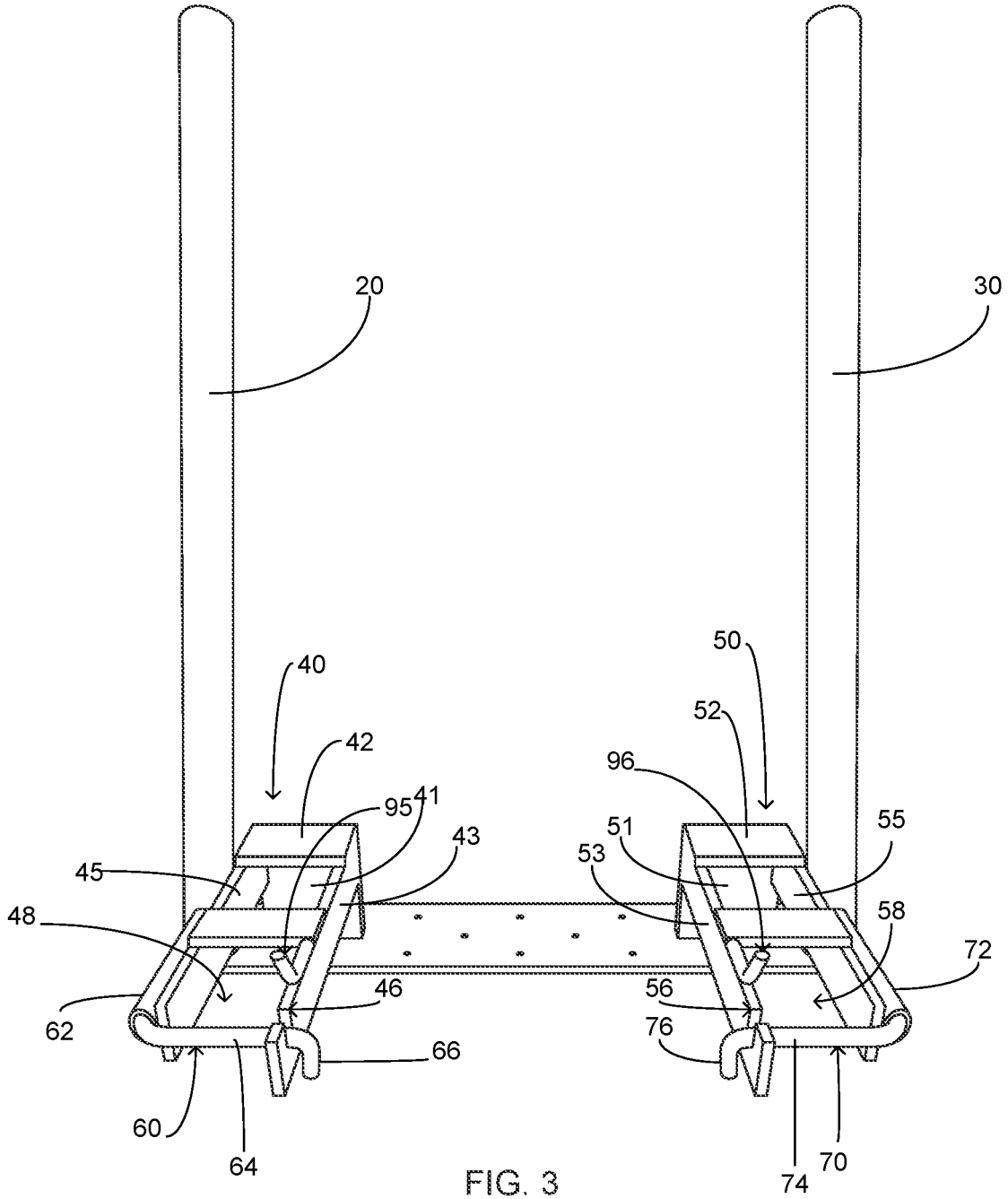
FIG. 3 is a rear view of the present invention.

Referring now to the drawings submitted herewith, wherein various elements depicted therein are not necessarily drawn to scale and wherein through the views and figures like elements are referenced with identical reference numerals, there is illustrated a ladder safety apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the drawings submitted herewith, the ladder safety apparatus 100 includes a roof support member 10. The roof support member 10 is planar in manner and includes a first end 11 and a second end 12. The roof support member 10 is manufactured from a durable rigid material such as but not limited to metal. The roof support member 10 has a plurality of apertures 15 journaled therethrough. The apertures 15 extend intermediate the first end 11 and second end 12. The apertures 15 provide the ability for the roof support member 10 to be secured to a rooftop utilizing a desired fastener so as to secure the ladder safety apparatus 100 to a rooftop proximate the edge thereof. It should be understood within the scope of the present invention that the roof support member 10 could have alternate quantity of apertures 15 in order to accomplish the desired objective discussed herein.

Secured to the first end 11 of the roof support member 10 is the first grab rail member 20. The first grab rail member 20 is secured to the roof support member 10 utilizing suitable durable techniques such as but not limited to welding. The first grab rail member 20 is manufactured from a rigid material such as but not limited to metal tubing. The first grab rail member 20 extends upward from the roof support member 10 and is further angularly oriented thereto. The angle of the first grab rail support member 20 is configured so as to be axially aligned with the angle of the ladder that is operably coupled to the ladder safety apparatus 100. While it is contemplated within the scope of the present invention that the first grab rail member 20 could be provided in alternate lengths, good results have been achieved having a first grab rail member 20 that is at least three feet in length.

Mounted to the second end 12 of the roof support member 10 is the second grab rail member 30. The second grab rail member 30 is secured to the roof support member 10 utilizing suitable durable techniques such as but not limited to welding. The second grab rail member 30 is manufactured from a rigid material such as but not limited to metal tubing. The second grab rail member 30 extends upward from the roof support member 10 and is further angularly oriented thereto. The angle of the second grab rail support member 30 is configured so as to be axially aligned with the angle of the ladder that is operably coupled to the ladder safety apparatus 100. The second grab rail member 30 is manufactured to be the same length as the first grab rail member 20.

The ladder safety apparatus 100 further includes a first ladder rail receiving member 40. The first ladder rail receiving member 40 is configured to operably couple to the end of an extension ladder in order to inhibit movement thereof. The first ladder rail receiving member 40 includes a rear support assembly having a first support plate 41 and a second support plate 42. The first support plate 41 and second support plate 42 are perpendicular in configuration. Extending outward from the rear support assembly is a first lateral support member 43 and a second lateral support member 45. The first lateral support member 43 and second lateral support member 45 are parallel to each other and perpendicular to the first support plate 41 and have a void 48 therebetween that is suitable in width to accommodate a rail of an extension ladder therein. The first lateral support member 43 includes a notch 46 formed therein that is distally located with respect to the first support plate 41. As is further discussed herein the notch 46 is operable to receive and retain therein the first hook member 60.

A second ladder rail receiving member 50. The second ladder rail receiving member 50 is configured to operably couple to the end of an extension ladder in order to inhibit movement thereof. The second ladder rail receiving member 50 includes a rear support assembly having a first support plate 51 and a second support plate 52. The first support plate 51 and second support plate 52 are perpendicular in configuration. Extending outward from the second rear support assembly is a first lateral support member 53 and a second lateral support member 55. The first lateral support member 53 and second lateral support member 55 are parallel to each other perpendicular to the first support plate 51 and have a void 58 therebetween that is suitable in width to accommodate a rail of an extension ladder therein. The first lateral support member 53 includes a notch 56 formed therein that is distally located with respect to the first support plate 51. As is further discussed herein the notch 56 is operable to receive and retain therein the first hook member 70.

The first hook member 60 is operably coupled to the first ladder receiving member 40. The first hook member 60 is configured to ensure engagement of a ladder riser with the first ladder rail receiving member 40 inhibiting the accidental decoupling thereof. The first hook member 60 is movably secured in the first mounting tube 62 that is secured to second lateral support member 45. The first hook member 60 includes a portion 64 and an end portion 66. Portion 64 is position over a ladder riser present in void 48 while end portion 66 engages the notch 46 so as to inhibit movement of the first hook member 60. The first hook member 60 is placed in its closed position as is illustrated herein subsequent a ladder being operably coupled to the ladder safety apparatus 100. While a first hook member 60 has been illustrated and discussed herein, it is contemplated within the scope of the present invention that the ladder safety apparatus 100 could employ alternate elements and/or techniques to secure the ladder riser.

The second hook member 70 is operably coupled to the second ladder receiving member 50. The second hook member 70 is configured to ensure engagement of a ladder riser with the second ladder rail receiving member 50 inhibiting the accidental decoupling thereof. The second hook member 70 is movably secured in the second mounting tube 72 that is secured to second lateral support member 55. The second hook member 70 includes a portion 74 and an end portion 76. Portion 74 is position over a ladder riser present in void 58 while end portion 76 engages the notch 56 so as to inhibit movement of the second hook member 70. The second hook member 70 is placed in its closed position as is illustrated herein subsequent a ladder being operably coupled to the ladder safety apparatus 100. While a second hook member 70 has been illustrated and discussed herein to work in conjunction with the first hook member 60, it is contemplated within the scope of the present invention that the ladder safety apparatus 100 could employ alternate elements and/or techniques to secure the ladder risers.

A first riser engagement member 95 and a second riser engagement 96 are secured to the first ladder rail receiving member 40 and second ladder rail receiving member 50 respectively. The first riser engagement member 95 and second riser engagement member 96 are identically constructed and serve to engage a rear edge of a ladder riser upon an extension ladder being initially coupled to the ladder safety apparatus 100. This secures the extension ladder sufficiently so as to allow a user to ascend and then position the first hook member 60 and second hook member 70 in their second position wherein the first hook member 60 and second hook member 70 are superposed opposite rails on the extension ladder. The first riser engagement member 95 and second riser engagement member 96 include rear portions 97,98 that are angularly oriented upwards and away from the roof support member 10. This position achieves the aforementioned securing of a ladder riser. It should be understood within the scope of the present invention that the first riser engagement member 95 and second riser engagement member 96 could be manufactured in alternate shapes and sizes in order to achieve the desired objective discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A ladder safety apparatus that is configured to releasably secure a top end of a ladder proximate a rooftop wherein the ladder safety apparatus comprises:

a roof support member, said roof support member having a first end and a second end, said roof support member being planar in manner, said roof support member having at least two apertures distally located on said roof support member, said roof support member having an upper surface;

a first grab rail member, said first grab rail member being secured to said roof support member proximate said first end of said roof support member, said first grab rail member extending upward from said roof support member;

a second grab rail member, said second grab rail member being secured to said roof support member proximate said second end of said roof support member, said second grab rail member extending upward from said roof support member;

a first ladder rail receiving member, said first ladder rail receiving member being proximate said first end of said roof support member, said first ladder rail receiving member having a void configured to have a first ladder rail placed therein;

a second ladder rail receiving member, said second ladder rail receiving member being proximate said second end of said roof support member, said second ladder rail receiving member having a void configured to have a second ladder rail placed therein;

a first riser engagement member, said first riser engagement member being secured to said first ladder rail receiving member, said first riser engagement member having a portion angled upward from the first ladder rail receiving member, said first riser engagement member operable to engage a rear edge of a ladder riser that is horizontally intermediate the first ladder rail and the second ladder rail; and a second riser engagement member, said second riser engagement member being secured to said second ladder rail receiving member, said second riser engagement member having a portion angled upward from the second ladder rail receiving member, said second riser engagement member operable to engage a rear edge of the ladder riser that is horizontally intermediate the first ladder rail and the second ladder rail.

2. The ladder safety apparatus as recited in claim 1, and further including a first hook member, said first hook member being operably coupled to said first ladder rail receiving member, said first hook member configured to superpose the first ladder rail disposed in the void of said first ladder rail receiving member.

3. The ladder safety apparatus as recited in claim 2, wherein said first grab rail member is angularly oriented with respect to said roof support member so as to be axially aligned with the first ladder rail coupled to the ladder safety apparatus.

4. The ladder safety apparatus as recited in claim 3, and further including a second hook member, said second hook member being operably coupled to said second ladder rail receiving member, said second hook member configured to superpose the second ladder rail disposed in the void of said second ladder rail receiving member.

5. The ladder safety apparatus as recited in claim 4, wherein said first ladder rail receiving member further includes a notch, said notch configured to receive an end portion of said first hook member so as to releasably secure said first hook member over a portion of the first ladder rail disposed in the void of said first ladder rail receiving member.

6. The ladder safety apparatus as recited in claim 5, wherein said second ladder rail receiving member further includes a notch, said notch of said second ladder rail receiving member configured to receive an end portion of said second hook member so as to releasably secure said second hook member over a portion of the second ladder rail disposed in the void of said second ladder rail receiving member.

7. A ladder safety apparatus configured to be secured to a flat roof top proximate an edge of the flat rooftop so as to releasably secure a top end of an extension ladder wherein the ladder safety apparatus comprises:

a roof support member, said roof support member having a first end and a second end, said roof support member being planar in manner, said roof support member having at least two apertures distally located on said roof support member, said roof support member having an upper surface, said roof support member having a first longitudinal edge and a second longitudinal edge, said roof support member being rectangular in shape;

a first grab rail member, said first grab rail member being tubular in shape, said first grab rail member being secured to said upper surface of said roof support member proximate said first end of said roof support member, said first grab rail member extending upward from said roof support member;

a second grab rail member, said second grab rail member being tubular in shape, said second grab rail member being secured to said roof support member proximate said second end of said roof support member, said second grab rail member extending upward from said roof support member;

a first ladder rail receiving member, said first ladder rail receiving member being proximate said first end of said roof support member, said first ladder rail receiving member having a first support plate and a second support plate, said first support plate being secured to said upper surface of said roof support member and being perpendicular thereto, said second support plate being secured to said first support plate distal to said roof support member, said second support plate being perpendicular to said first support plate, said first ladder rail receiving member having a first lateral support member and a second lateral support member, said first lateral support member and said second lateral support member having a void therebetween configured to receive a portion of a first ladder rail;

a second ladder rail receiving member, said second ladder rail receiving member being proximate said second end of said roof support member, said second ladder rail receiving member having a first support plate and a second support plate, said first support plate of said second ladder rail receiving member being secured to said upper surface of said roof support member and being perpendicular thereto, said second support plate of said second ladder rail receiving member being secured to said first support plate of said second ladder rail receiving member distal to said roof support member, said second support plate of said second ladder rail receiving member being perpendicular to said first support plate of said second ladder rail receiving member, said second ladder rail receiving member having a first lateral support member and a second lateral support member, said first lateral support member of said second ladder rail receiving member and said second lateral support member of said second ladder rail receiving member having a void therebetween configured to receive a portion of a second ladder rail;

a first riser engagement member, said first riser engagement member being secured to said first ladder rail receiving member, said first riser engagement member having a portion angled upward from the first ladder rail receiving member, said first riser engagement member operably to engage a rear edge of a ladder riser that is horizontally intermediate the first ladder rail and the second ladder rail; and a second riser engagement member, said second riser engagement member being secured to said second ladder rail receiving member, said second riser engagement member having a portion angled upward from the second ladder rail receiving member, said second riser engagement member operably to engage a rear edge of the ladder riser that is horizontally intermediate the first ladder rail and the second ladder rail.

8. The ladder safety apparatus as recited in claim 7, and further including a first hook member, said first hook member being movably coupled to said first ladder rail receiving member, said first hook member having a first portion and a second portion, said second portion being perpendicular to said first portion and extending in a downward direction, said first hook member operable to superpose the first ladder rail disposed in the void of the first ladder rail receiving member.

9. The ladder safety apparatus as recited in claim 8, wherein said first grab rail member is mounted at an angular orientation so as to be axially aligned with a ladder engaged with the ladder safety apparatus.

10. The ladder safety apparatus as recited in claim 9, and further including a second hook member, said second hook member being movably coupled to said second ladder rail receiving member, said second hook member having a first portion and a second portion, said second portion of said second hook member being perpendicular to said first portion of said second hook member and extending in a downward direction, said second hook member operable to superpose the second ladder rail disposed in the void of the second ladder rail receiving member.

11. The ladder safety apparatus as recited in claim 10, wherein said second grab rail member is mounted at an angular orientation so as to be axially aligned with a ladder engaged with the ladder safety apparatus.

12. The ladder safety apparatus as recited in claim 11, wherein said first hook member is rotatably coupled to a first mounting tube member, said first mounting tube member being secured to said second lateral support member of said first ladder rail receiving member.

13. The ladder safety apparatus as recited in claim 12, wherein said first lateral support member of said first ladder rail receiving member includes a notch in an upper edge thereof, said notch operable to receive said first portion of said first hook member.

14. The ladder safety apparatus as recited in claim 13, wherein said second hook member is rotatably coupled to a second mounting tube member, said second mounting tube member being secured to said second lateral support member of said second ladder rail receiving member.

15. The ladder safety apparatus as recited in claim 14, wherein said first lateral support member of said second ladder rail receiving member includes a notch in an upper edge thereof, said notch in said first lateral support member of said second ladder rail receiving member operable to receive said first portion of said second hook member.

* * * * *